United States Patent [19]

Yamamoto et al.

[11] Patent Number: 4,577,984

[45] Date of Patent: Mar. 25, 1986

[54] PAPER FEEDING DEVICE FOR A PRINTING APPARATUS PROVIDING ALTERNATIVELY DIFFERENT FEED PATHS

[75] Inventors: Takemi Yamamoto; Susumu Kuzuya; Isao Kagami; Yuuichi Takenaka, all of Nagoya, Japan

[73] Assignee: Brother Kogyo Kabushiki Kaisha, Nagoya, Japan

[21] Appl. No.: 541,419

[22] Filed: Oct. 13, 1983

[30] Foreign Application Priority Data

Dec. 7, 1982 [JP] Japan ..... 57-214315
Dec. 13, 1982 [JP] Japan ..... 57-188769[U]

[51] Int. Cl.[4] ..... B41J 13/10

[52] U.S. Cl. ..... 400/625; 400/605; 400/629; 271/3

[58] Field of Search ..... 400/605, 624, 625, 626, 400/627, 628, 629, 54, 144.2, 320; 271/3, 3.1, 8, 9, 109, 116, 117, 270, 279

[56] References Cited

U.S. PATENT DOCUMENTS 4,161,312 7/1979 Eckhardt et al. ..... 271/3
4,326,815 4/1982 Kapp ..... 400/625
4,391,542 7/1983 Baitz ..... 400/624
4,398,837 8/1983 Torii et al. ..... 400/54 X

FOREIGN PATENT DOCUMENTS 0077145 5/1982 Japan ..... 271/8 R
0028396 2/1983 Japan ..... 400/624

*Primary Examiner*—Ernest T. Wright, Jr.
*Attorney, Agent, or Firm*—Browdy and Neimark

[57] ABSTRACT

A paper feeding device for a printer having a first paper handling assembly including rollers for feeding sheets of paper of one kind from a first paper stacker along a first inlet path to a printing assembly of the printer, and a second paper handling assembly including a second stacker for receiving the printed sheets from the first stacker, and supported by a support member pivotally between first and second positions. The support member carries at least one paper guide which is pivotable between its first and second positions according to pivotal movements of the support member. In the first position, the paper guide defines a paper exit path opening through which the printed sheets are guided into the second stacker. When the paper guide is pivoted to its second position, it closes the paper exit path opening. The feeding device further comprises a member or members defining a second inlet path adjacent the second paper handling assembly when the support member is in the second position. The second inlet path leads to the printing assembly to load sheets of paper of another kind to the printing assembly when the feeding device is inoperative, and an amount of initial advancement of the paper to the printing assembly is changed when the inoperative position of the feeding device is detected.

19 Claims, 9 Drawing Figures

A
B
Q
P
W
S1
1
2
3
4
5
6
7
8
10
14
14a
15
16
17
17a
18
19
19a
21
56
58
59
60
61
62
63
64
65
66
66a
100

PAPER FEEDING DEVICE FOR A PRINTING APPARATUS PROVIDING ALTERNATIVELY DIFFERENT FEED PATHS

BACKGROUND OF THE INVENTION

The present invention relates to a printing apparatus including a printing assembly and a paper feeding device for feeding individual sheets of paper one after another from a paper storage stacker to the printing assembly along a paper inlet path. More particularly, the invention is concerned with such paper feeding device which provides another paper inlet path along which sheets of paper of another kind are loaded to the printing assembly.

In the art of a paper feeding apparatus having a paper stacker or tray for storing a stack of paper sheets of one kind, it has been required to remove the paper stacker from a printer when it is desired to print on a sheet of paper of another kind which is different in size or format from said one kind. This removal of the stacker which is required to permit loading of said another kind of paper sheet without interference with the paper stacker, is combersome and time-consuming. There is also available in the art another type of paper feeding apparatus which has two paper stackers for feeding respective two kinds of paper different in size or format. In this type of feeding apparatus, one stacker is used for storing frequently used kind of sheets and the other for storing another kind of sheets which are less frequently used and on which an interruption printing is effected while successive printings on the frequently used sheets are stopped temporarily. This two-stacker feeding apparatus is inherently complicated in construction and has a drawback that two or more sheets superposed for carbon copies are not smoothly and accurately fed because the feeding device acts on only the top sheet of a paper stack in the storage stacker.

On the other hand, a printing apparatus having a paper feeding device is usually provided with an automatic paper insertion and guide assembly to insert a sheet of paper from a stacker along the circumference of a platen and advance the inserted paper sheet up to its printing start position. However, since the amount of paper feed and advancement by the feeding device and the insertion and guide assembly is fixed for the sheets of paper stored in the paper stacker, it has been required to adjust the amount of paper advancement when a sheet of paper of another kind is loaded for printing during interruption of a printing operation on the sheets of paper fed from the paper stacker.

SUMMARY OF THE INVENTION

It is accordingly an object of the present invention to provide a paper feeding device for a printer, which has a paper stacker for storing sheets of paper of one kind and is capable of allowing easy interruption of continuous or successive printings on such sheets of paper of one kind, and allowing fast setup for loading the printer with a sheet of paper of another kind different in size and/or format from said one kind and effecting during the interruption a printing operation on said another kind of paper sheets.

Another object of the invention is to provide such paper feeding device which is capable of changing an amount of initial paper advancement to a printing assembly of the printer when the sheet of paper to be printed is changed from one kind to another.

According to the present invention, there is provided a paper feeding device for a printer having a printing assembly, which comprises:

a frame secured to the printer;

a first paper handling assembly supported by the frame and having a first paper stacker for storing sheets of paper of one kind and paper feeding means for feeding the sheets of paper of one kind from the first paper stacker along a first paper inlet path to the printing assembly;

a second paper handling assembly having a second paper stacker for receiving the sheets of paper of one kind after they are printed by the printing assembly;

a sub-frame supporting the second paper handling assembly and retained by the frame pivotally between a first position and a second position;

at least one paper guide pivotally supported by the sub-frame;

paper guide actuating means for pivoting the paper guide between a first position and a second position according to the pivotal movement of the sub-frame between the first position and the second position, the paper guide defining, when placed in its first position, a paper exit path opening to guide the printed sheets of paper of said one kind from the first paper stacker toward the second paper stacker, the paper guide closing the paper exit path opening when the paper guide is placed in its second position; and means for defining a second paper inlet path adjacent the second paper handling assembly and leading to the printing assembly when the sub-frame is placed in the second position thereof, whereby sheets of paper of another kind different from said one kind are loaded to the printing assembly along the second paper inlet path when the second paper handling assembly is placed in its second position and the printed sheets of paper of said another kind are prevented from being received in the second paper stacker.

In the paper feeding device constructed as described above, a sheet of paper different from sheets of paper stored in a paper stacker can be easily loaded to the printing assembly along a second paper inlet path which is readily formed by simply moving the sub-frame from its first position to its second position. In this second position, a paper exit path opening through which sheets of paper from a first paper stacker is guided into a second paper stacker, is closed to prevent the different sheet of paper from being received in the second paper stacker.

According to another aspect of the present invention, there is provided a paper feeding device for a printer having a printing assembly and a paper insertion and guide assembly, which comprises:

a paper handling assembly including a first paper stacker and having an operative position and an inoperative position, the paper handling assembly feeding, when placed in the operative position, individual sheets of paper of one kind from the first paper stacker to the paper insertion and guide assembly along a first paper inlet path before the sheets of paper are individually advanced to the printing assembly by the paper insertion and guide assembly;

means for defining a second paper inlet path leading to the paper insertion and guide assembly along which sheets of paper of another kind different from said one kind are loaded to the paper insertion and guide assembly;

detection means for detecting the operative or inoperative position of the paper handling assembly, the detection means generating an electric detection signal representing the detected position of the paper handling assembly; and control means for changing, upon detection of the inoperative position by the detection means, an amount of advancement of the paper by the paper insertion and guide assembly.

In the paper feeding device according to this aspect of the invention, an amount of initial paper advancement by the paper insertion and guide assembly is changed when the detection means detects an inoperative position of the paper handling assembly.

BRIEF DESCRIPTION OF THE DRAWING

The above and other objects, features and advantages of the present invention will become more apparent from reading the following description of the preferred embodiment taken in connection with the accompanying drawing in which.

DETAILED DESCRIPTION OF THE PREFERRED EMBODIMENT

Figure 1A:
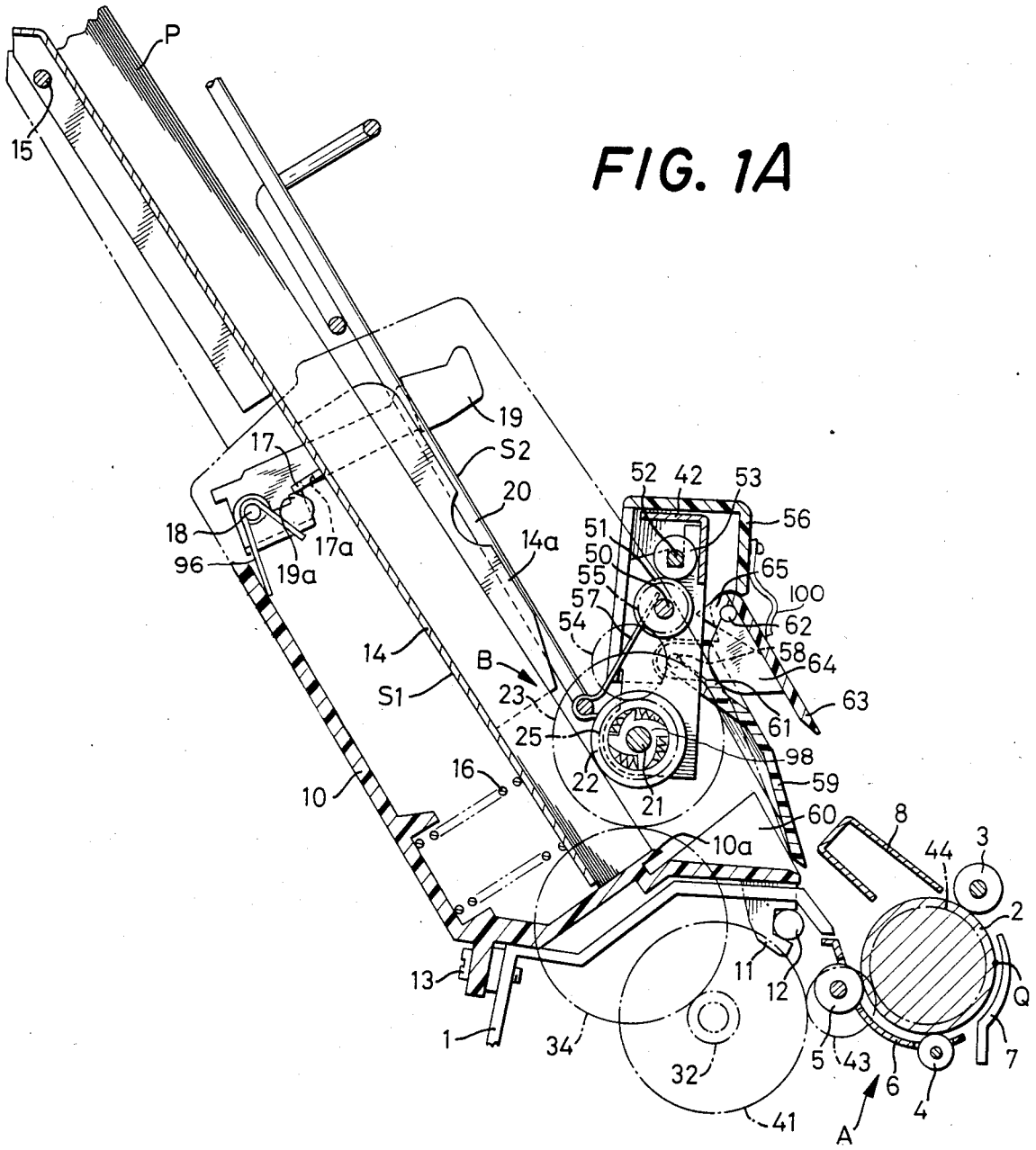
FIG. 1A is a fragmentary side elevation, partly in cross section, of a paper feeding device for a printing apparatus embodying the present invention.
Figure 1B:
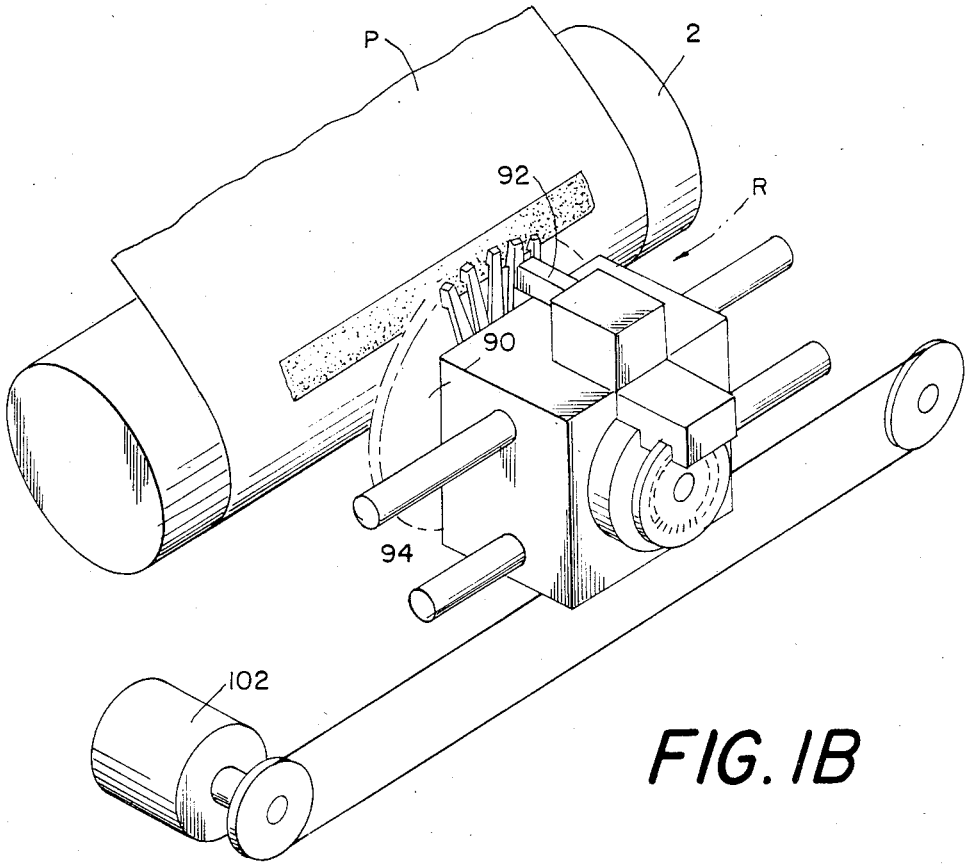
FIG. 1B is a perspective view of the printing apparatus, illustrating in particular a printing assembly, a carriage and a carriage drive.

Referring first to FIGS. 1A and 1B, there are shown a platen 2 which is rotatably supported in a typewriter frame 1, and a plurality of guide rollers 3, 4, 5 which are disposed in the frame 1 such that they are spaced from each other circumferentially of, and kept in engagement with, the platen 2. A paper guide pan 6 is disposed below the platen 2, and a printing assembly R is located in front of the platen 2. The printing assembly includes a card-holder 7, a type element 90 as in the form of a print wheel and a print hammer 92. The type element 90 is carried on a carriage 94 and moved together with the carriage 94 in a longitudinal direction along the length of the platen 2. Above the platen 2 is provided a guide plate 8 having a planar section extending along a line substantially tangent to the circumference of the platen 2. The platen 2, and guide rollers 3–5 constitute a part of paper insertion and guide assembly A for inserting a sheet of paper P and advancing it by rotation of the platen 2.

On the rear side of the platen 2, there is provided a main frame 10 which is fixed to the frame 1 by means of its retainer hooks 11 and fixing screws 13 provided at its lower part. The retainer hooks 11 engage attaching pins 12 secured to the frame 1 and the fixing screws 13 are screwed in the frame 1.

Figures 3, 4, 5:
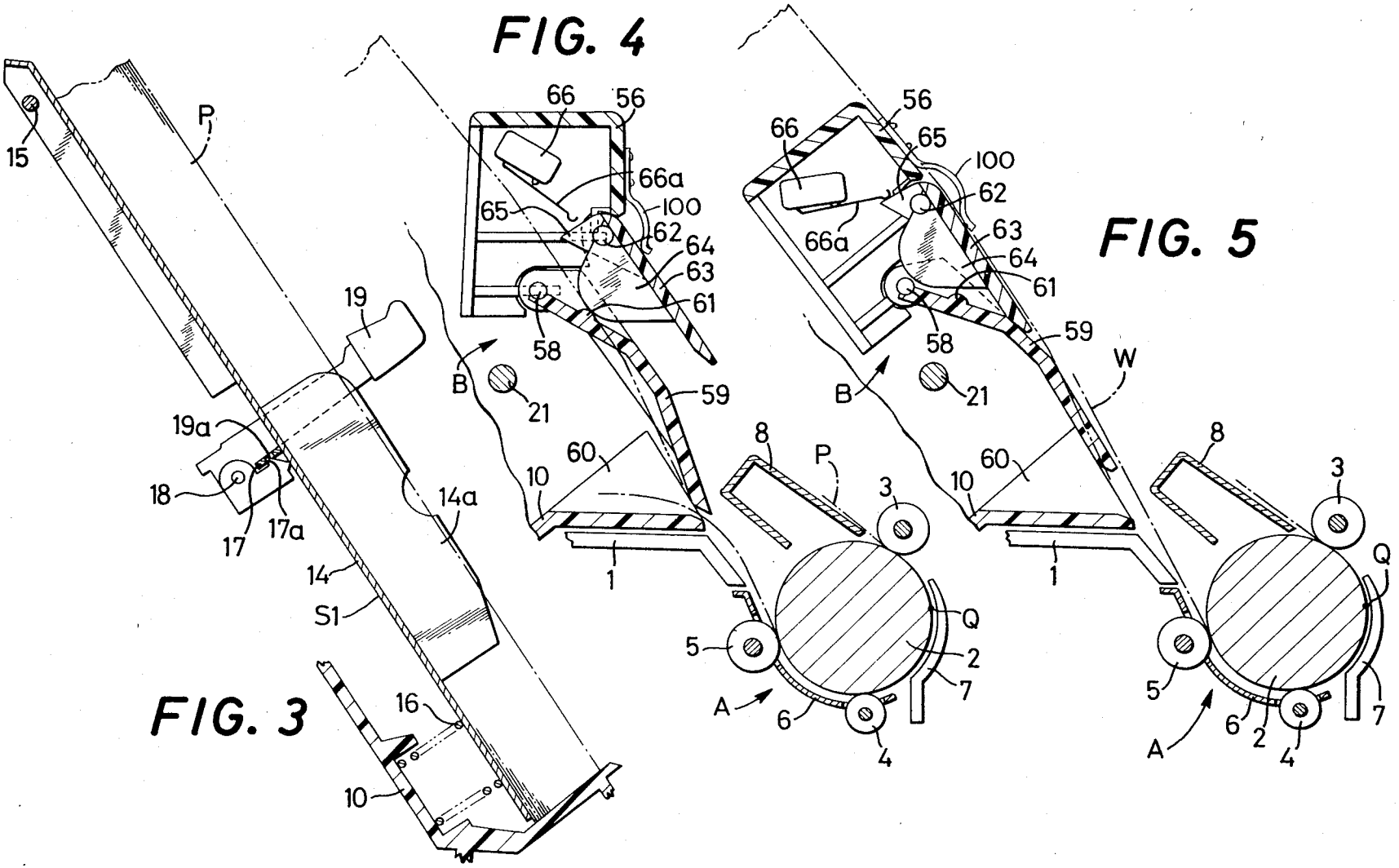
FIG. 3 is a view illustrating the operation of a first stacker of the paper feeding device.
FIGS. 4 and 5 are views showing the operation of the paper feeding device.

The main frame 10 carries a first paper stacker member 14 which is made of a metal sheet and press-formed into a desired shape. The stacker member 14 is pivotally supported by a support shaft 15 at the upper end of the main frame 10, and has a front surface on which sheets of paper P are stacked before printing on those sheets is started. The stacker member 14 is biased counterclockwise as seen in FIG. 1 by a compression spring 16 disposed between the lower end portion of the member 14 and the main frame 10. On opposite sides at the central portion of the stacker member 14, are provided guide walls 14*a* which extend from the front surface so that they orient and position the side edges of a stack of paper P placed on the front surface. The first stacker member 14 also has a projection 17 which extends from the rear surface thereof and which has a perforation 17*a*. Adjacent this projection 17 is disposed a lock lever 19 which is supported pivotally by a shaft 18 secured to the main frame 10. The lock lever 19 includes, at its fixed end, a detent pawl 19*a* which is engageable with the perforation 17*a*. The lock lever 19 is biased by a spring 96 in the direction that causes its detent pawl 19*a* to engage the perforation 17*a*. The first stacker member 14, and the bottom wall of the main frame 10 on which the lower edge of the stack of paper P abuts, form a substantive part of a first stacker S1. When the first stacker S1 is loaded or re-loaded with a stack of paper P of desired size, the first stacker member 14 is first depressed against a resilient force of the compression spring 16 to obtain an increased space between the front surface of the member 14 and feed rollers 22, and then the lock lever 19 is manipulated so that the detent pawl 19*a* is put into engagement with the perforation 17*a*. With the first stacker member 14 thus retained in its locked position as illustrated in FIG. 3, the stack of paper P is readily loaded on the stacker member 14. When the lock lever 19 in this condition is depressed downwardly as seen in FIG. 1, the detent pawl 19*a* disengages from the perforation 17*a* and the first stacker member 14 is pivotally moved by the resiliency of the compression spring 16 until the top sheet of the paper stack is forced into contact with the feed rollers 22.

Figure 2:
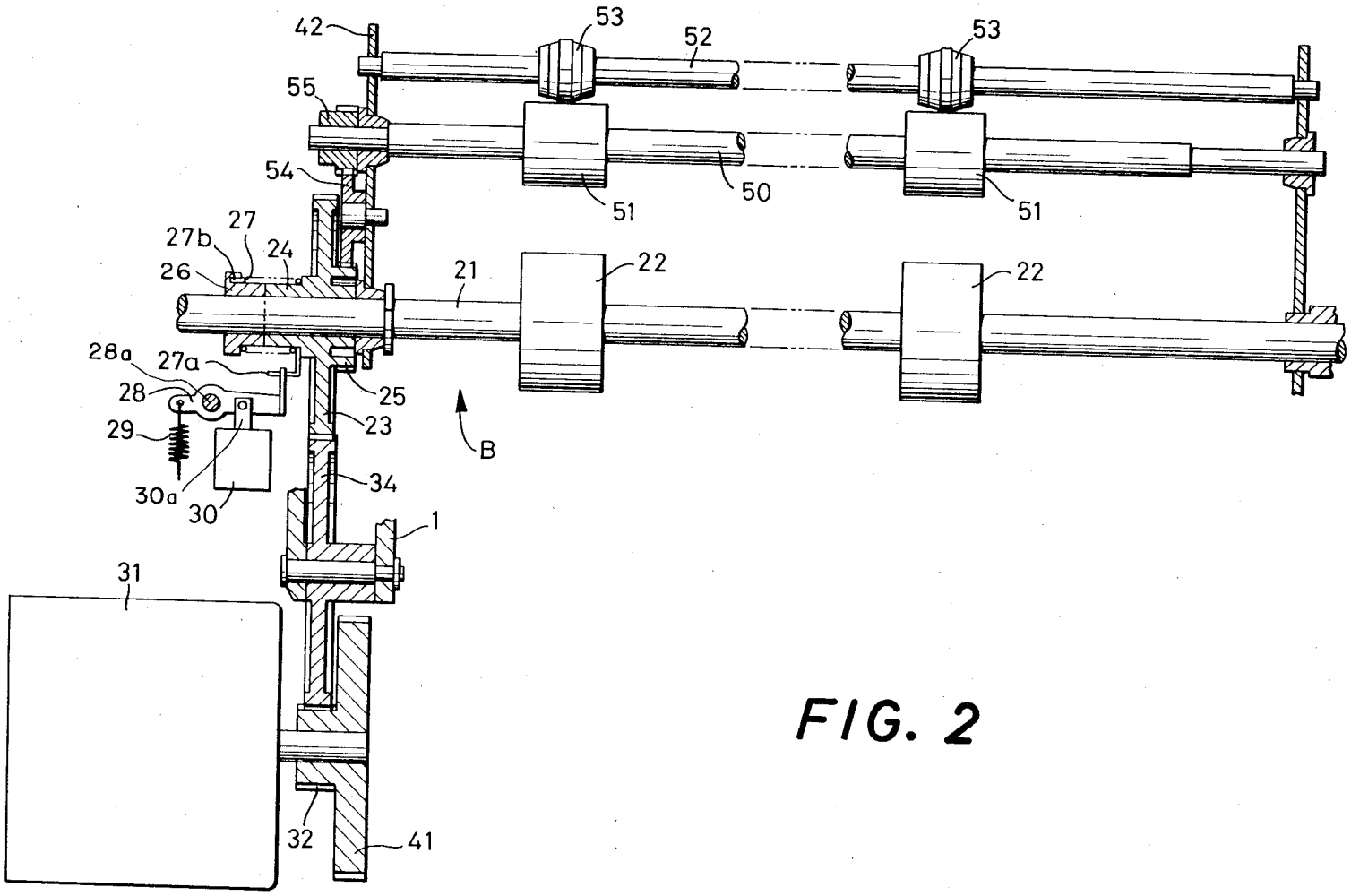
FIG. 2 is a front elevation, partly in cross section, of a part of a paper feeding device of the printing apparatus of FIG. 1.

As illustrated in FIG. 1A, the typewriter frame 1 also carries a second stacker member 20 which is fabricated from wires and located in front of the first stacker member 14. The main frame 1 further carries, as shown in FIGS. 1A and 2, a feed drive shaft 21 which is rotatably supported and extends in parallel with the platen 2. The feed drive shaft 21 has the pair of feed rollers 22 which are spaced apart from each other longitudinally of the shaft 21. Between the feed drive shaft 21 and the feed rollers 22 are interposed one-way clutches 98 which permit the feed rollers 22 to rotate integrally with the drive shaft 21 when the drive shaft 21 is rotated to feed the paper P toward the platen 2 (in the counterclockwise direction as viewed in FIG. 1A). The one-way clutches 98 allow free rotation of the feed rollers 22 on the feed shaft 21 after the counterclockwise rotation of the shaft 21 has been stopped and the leading end of the paper P pulled in the paper feed direction by the paper insertion and guide assembly A. As shown in FIG. 2, the feed drive shaft 21 carries, at its left-hand side end, a driven gear 23 which is supported rotatably relative to the shaft 21. The driven gear 23 is formed with an integral sleeve portion 24 and an integral first intermediate gear 25. The feed drive shaft 21 further has a sleeve 26 which is secured thereto at a position adjacent the sleeve portion 24. Between the sleeve portion 24 and the sleeve 26 is mounted a clutch spring 27 which has a fixing end 27*b* fixedly inserted in the sleeve 26. The clutch spring 27 is wound around the sleeve portion 24 and sleeve 26 such that it is normally kept in its tightened position. The direction of winding of the spring 27 is identical to the direction in which the driven gear 23 is rotated. The spring 27 further has an operating end 27*a* extending radially outwardly thereof. Adjacent the sleeve 26 is pivotally supported a pivot member 28 which is connected, at a portion near its fulcrum 28*a*, to an armature 30*a* of a solenoid 30 provided in proximity with the member 28. The pivot member 28 is biased in one direction by a tension spring 29.

When the solenoid 30 is held in its non-energized position, one end of the pivot member 28 is moved by the tension spring 29 so that the end lies in the rotational path of the operating end 27*a* of the clutch spring 27. Upon rotation of the driven gear 23 with the above end of the pivot member 28 held in the rotational path, the operating end 27*a* is held by the pivot member 28 and the clutch spring 27 is loosened whereby the driven gear 23 is disconnected from the sleeve 26. On the other hand, when the solenoid 30 is energized and the pivot member 28 is pivoted against the resilient force of the tension spring 29, the end of the member 28 is brought out of the rotational path of the operating end 27*a* and consequently the clutch spring 27 is allowed to be rewound tightly on the sleeve 26 and the sleeve portion 24 of the driven gear 23, whereby the connection between the sleeve 26 and sleeve portion 24 of the driven gear 23 is obtained again.

A stepper motor 31 disposed within the typewriter frame 1, has a small-diameter drive gear 32 and a large-diameter, second intermediate gear 41 which are supported on the motor shaft 31*a* such that they are rotatable as a unit. The second intermediate gear 41 is connected, as illustrated in FIG. 1A, through a third intermediate gear 43 to a driven gear 44 concentric with the platen 2 so that the rotary movement of the stepper motor 31 is transmitted to the platen 2. The frame 1 supports, between the drive gear 32 and the driven gear 23, a fourth intermediate gear 34 which meshes with the gears 32 and 23.

The feed drive shaft 21 pivotally supports support frames 42 which in turn rotatably carries a first support rod 50 and a second support rod 52 both extending in parallel to the drive shaft 21. The first support rod 50 has a first pair of spaced apart ejection rollers 51 fixed thereto, and the second support rod 52 a second pair of ejection rollers 53 which are fixed thereto in spaced apart relation so that they engage the ejection rollers 51, respectively. When the driven gear 23 is rotated, the first support rod 50 carrying the first pair of ejection rollers 51 is rotated via the first intermediate gear 25, a fifth intermediate gear 54 supported by the support frame 42 and a sixth intermediate gear 55 supported by the support rod 50. The first pair of ejection rollers 51 thus rotated will cause the second pair of ejection rollers 53 and consequently the second support rod 52 to rotate together. The previously discussed second stacker member 20 has at its lower end a resilient member 57 whose one end is held by the lower end of the member 20, and whose the other end is resiliently forced against the circumference of the first support rod 50. The second stacker member 20 and the resilient member 57 constitute a second stacker S2 in which sheets of paper P are received in stack after printing has been effected on those sheets.

On the support frame 42, there is supported a sub-frame 56 of synthetic resin which is pivoted, integrally with the frame 42, about the feed drive shaft 21 between its first or operative position at which it stands upright as shown in FIG. 4, and its second or inoperative (retracted) position at which it is inclined and accommodated within the main frame 10 as shown in FIG. 5.

Support pins 58 extending inwardly from opposite sides of the sub-frame 56 and each pivotally supports a first paper guide 59 at its upper end, the lower end thereof being adapted to contact with a mating guide portion 60 of the main frame 10. This first paper guide 59 has a protuberance 61 adjacent its pivotal fulcrum, i.e., support pin 58. A second paper guide 63 is also pivotally supported at its upper end by support pins 62 which are located above the support pins 58 and extend inwardly from the opposite sides of the sub-frame 56. The second paper guide 63 has, on its inner surface, an operating piece 64 secured thereto which is adapted to be engageable with the protuberance 61, and at its fixed end a dog piece 65 protruding into the interior of the sub-frame 56. The second paper guide 63 is biased by a spring 100 in the direction that causes it to pivot clockwise as viewed in FIGS. 4 and 5, whereby the operating piece 64 is kept in contact with the protuberance 61. On the inner upper side surface of the sub-frame 56, is disposed a limit switch 66 having an actuator piece 66*a* which is engageable with the dog piece 65 of the second paper guide 63 in order to turn on and off the limit switch 66.

As described above, a paper feeding device B which is connected to the paper insertion and guide assembly A by transmission means (32, 41, 43, 44, 34, 23-27, 54, 55, etc.) comprises a first paper handling assembly including the first stacker S1, and a second paper handling assembly including the second stacker S2. The first paper handling assembly further includes paper feeding means (feed rollers 22) and means for defining a first paper inlet path (10, 59, etc.) leading to the paper insertion and guide assembly A. The second paper handling assembly further includes means for defining a paper exit path opening (8, 59, 63, etc.) and paper ejection means (50-53, etc.) through and by which the printed paper P is received in the second stacker S2. More specifically, the paper exit path opening is defined by the outer surface of the first paper guide 59 and the inner surface of the second paper guide 63 when the sub-frame 56 is placed in its first, operative position, i.e., when the second paper guide 63 is placed in its first position. The paper feed rollers 22 of the first paper handling assembly and the paper ejection means of the second paper handling assembly are connected by the transmission means including clutch means (24, 26, 27, etc.).

From the foregoing description, it is also apparent that the paper feeding device B is supported by support means (1, 10, 21, 42, 56, 62, etc.) and driven by drive means (31) through the clutch means (24, 26, 27, etc.) which is released by clutch release means (28, 30, etc.), and that the support means carries detection means (65, 66, etc.) which senses the current position, that is, operative or inoperative position, of the paper feeding device B.

Figure 6:
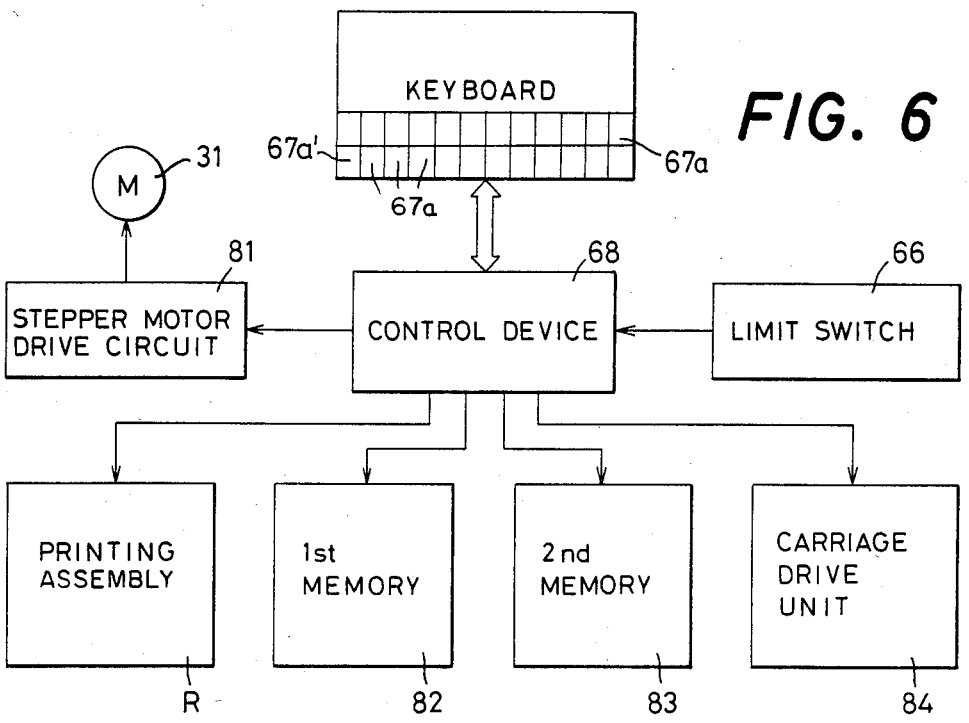
FIG. 6 is a schematic block diagram of a circuit for controlling the printing apparatus of the invention.
Figure 7:
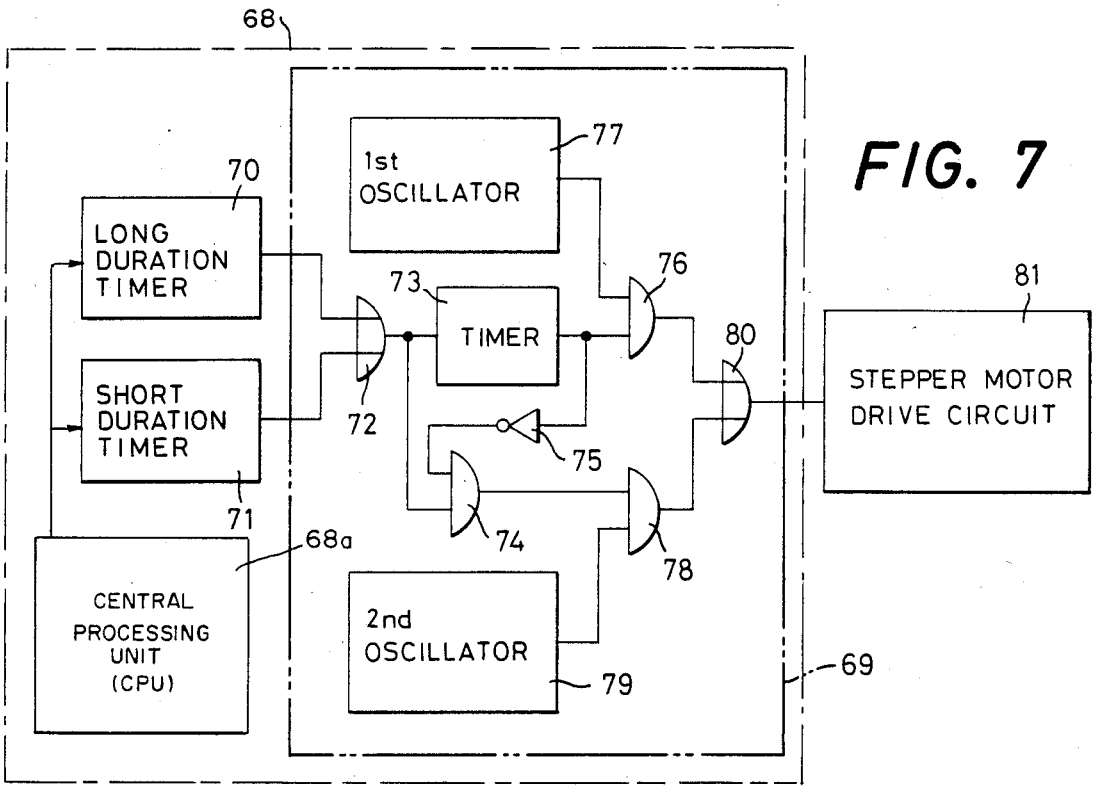
FIG. 7 is a schematic block diagram of a motor control circuit of the printing apparatus.
Figure 8:
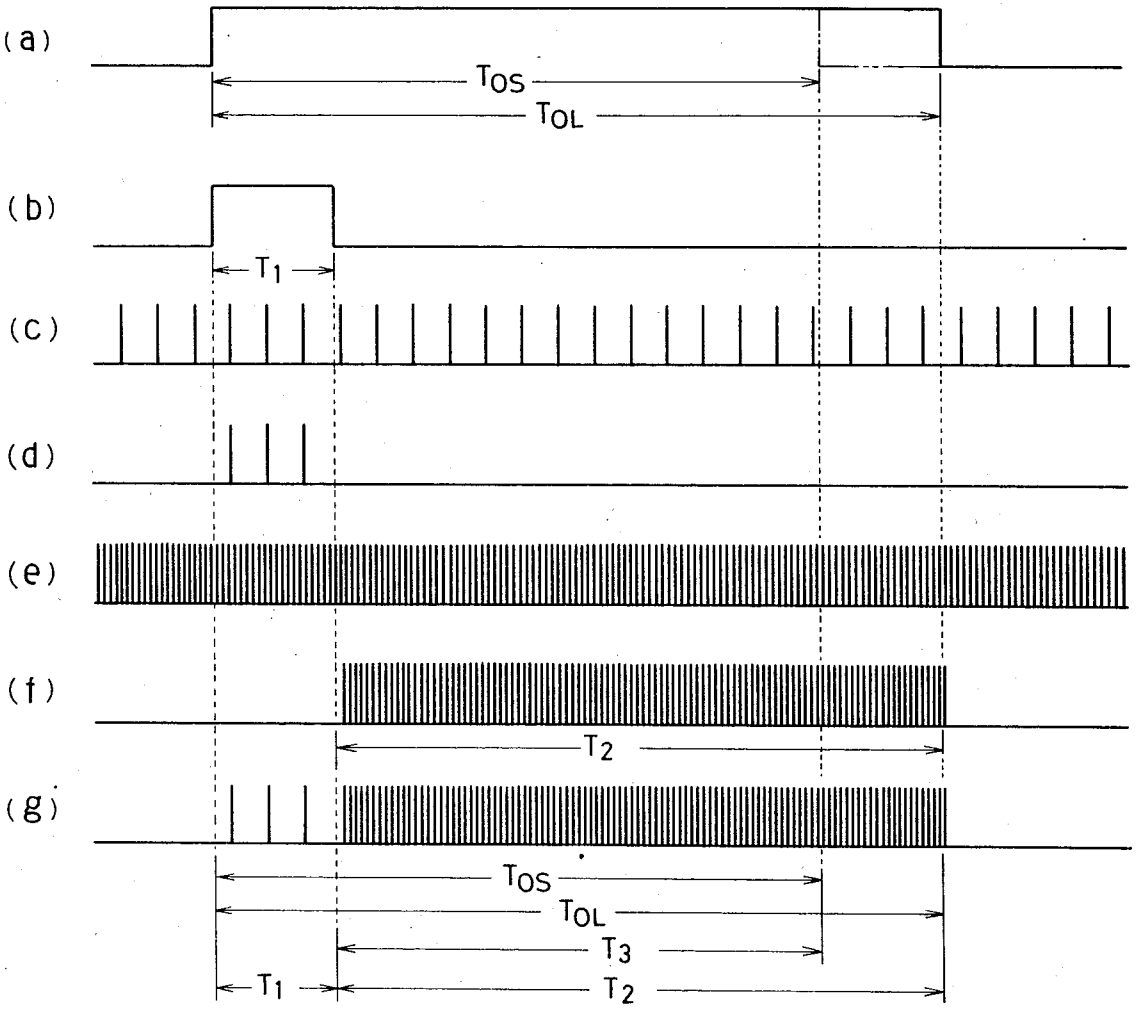
FIG. 8 is a diagrammatic representation illustrating the operation of the motor control circuit.

Referring next to FIGS. 6–8, the control of the present printing apparatus having the paper feeding device B is described.

As shown in FIG. 6, the limit switch 66 is connected to a control device 68 which controls the operation of the printing apparatus in response to actuation of various keys 67*a* provided on a keyboard 67.

The control device 68 includes, as illustrated in FIG. 7, a central processing unit (CPU) 68*a* which constitutes a major part of the control device 68, and a long-duration timer 70 and a short-duration timer 71 which regulate the operating period of time of the stepper motor 31 under the control of the central processing unit 68*a*. The control device 68 further incorporates a stepper motor control circuit 69 to which the above two timers 70, 71 are connected, and which controls the operating speed of the stepper motor 31.

The control device 68 functions to selectively render effective the long-duration timer 70 and the short-duration timer 71 according to the presence of signals from the PAPER INSERT key 67*a'* and the limit switch 66. The long-duration timer 70 is selected when the PAPER INSERT key 67*a'* is activated while the limit switch 66 is off, and the short-duration timer 71 is selected when the PAPER INSERT key 67*a'* and the limit switch 66 are both operated.

The outputs of the two timers 70 and 71 are respectively connected to two inputs of an OR gate 72 in the control circuit 69. The output of the OR gate 72 is connected to an input of a timer 73 and to one input of an AND gate 74. The output of the timer 73 is connected to the AND gate 74 through a NOT circuit 75, and to one input of another AND gate 76. The other input of the AND gate 76 receives the output of a first oscillator 77 which oscillates at a predetermined frequency n(Hz). The output of the AND gate 74 is applied to one input of still another AND gate 78 whose the other input receives the output of a second oscillator 79 which oscillates at a frequency 6n(Hz) which is six times as high as the frequency of the first oscillator 77. The outputs of the AND gates 76 and 78 are applied to two inputs of an OR gate 80, respectively, the output of which is in turn applied to a stepper motor drive circuit 81 whose output is connected to an excitation coil of the stepper motor 31.

The control device 68 also functions to selectively render effective a first memory 82 and a second memory 83 according to the presence or absence of a detection signal generated by the limit switch 66, as indicated in FIG. 6. In this specific embodiment of the printing apparatus, the control device 68 is arranged such that the second memory 83 is made effective when the detection signal from the limit switch 66 is present.

The first memory 82 which is a read/write memory wherein stored information can be read out or new information written in at any storage location, is used to store information on left and right margin settings and tabulation setting of a sheet of paper P used. The second memory 83 which is also a read/write memory is used to store information on such settings of a sheet of paper W which is different in size and/or format from the paper P. The control device 68 generates signals to control a carriage drive unite 84 according to the information read out from the first or second memory 82, 83 selected by the detection signal from the limit switch 66, whereby a carriage drive motor 102 (FIG. 1B) is controlled as required.

When a PAPER INSERT key 67*a'* on the keyboard 67 is pressed while an electric detection signal from the limit switch 66 is absent with the switch 66 kept in its open or off position as shown in FIG. 4, the solenoid 30 is energized and the long-duration timer 70 and the stepper motor control circuit 69 are activated. As a result, the stepper motor drive circuit 81 is activated to operate the stepper motor 31 for a long period of time. When the PAPER INSERT key 67*a'* is pressed while the limit switch 66 is in its closed or on position as shown in FIG. 5, on the other hand, the solenoid 30 is not energized and the short-duration timer 71 is activated. In this instance, the stepper motor 31 is operated for a short period of time according to the activated short-duration timer 71 and control circuit 69.

The operation of the printing apparatus constructed as discussed above will now be described.

In FIG. 1A, the lock lever 19 is in its unlocked position and the top of a fresh paper stack P on the first paper stacker member 14 is in contact with the feed rollers 22 under pressure. In this position, the sub-frame 56 is in its first, operative position, as illustrated in FIG. 4, wherein the operating piece 64 of the spring-biased second paper guide 63 is in contact with the protuberance 61 of the first paper guide 59 while the lower end of the first paper guide 59 is in abutment on the guide portion 60 of the main frame 10, whereby there is formed the paper exit path opening between the first and second paper guides 59 and 63. It is also noted in FIG. 4 that the dog piece 65 of the second paper guide 63 is spaced away from the actuator piece 66*a* of the limit switch 66 and consequently no electric detection signal from the switch 66 is applied to the control device 68.

In the above condition, the solenoid 30 is held in its non-energized position as shown in FIG. 2, at which the end of the pivot member 28 is held in engagement with the operating end 27*a* of the clutch spring 27 by means of the resilient force of the tension spring 29 acting on the opposite end of the member 28, whereby the clutch spring 27 is loosened on the sleeve portion 24 and sleeve 26 and the feed drive shaft 21 is disconnected from the driven gear 23.

When the PAPER INSERT key 67*a'* provided on the keyboard 67 to serve as manually operated trigger means for starting the stepper motor 31 is pressed, a predetermined signal is generated from the control device 68 and the solenoid 30 is energized in response to the generated signal. In consequence, the pivot member 28 is pivoted clockwise as seen in FIG. 2 against the tension spring 29 and the end of the pivot member 28 on the side connected to the solenoid 30 is brought out of the rotational path of the operating end 27*a* of the clutch spring 27. Thus, the clutch spring 27 is held in tightened condition wherein the spring 27 connects the sleeve 26 and the sleeve portion 24 of the driven gear 23. In the meantime, the activation of the PAPER INSERT key 67*a'* causes the stepper motor 31 to operate for a predetermined period of time according to the setting of the long-duration timer 70 in the control device 68. More specifically stated, the start of a time interval $T_{OL}$ (FIG. 8*a*) preset on the long-duration timer 70 will activate the timer 73 which operates for a predetermined time interval T1 as indicated in FIG. 8*b*. As the first oscillator 77 oscillates at a given frequency as shown in FIG. 8*c*, the AND gate 76 generates pulse signals at the same frequency only during the time interval T1 as represented in FIG. 8*d*. Upon expiration of the time interval T1 with the timer 73 timed out, a signal representing the expiration of the interval T1 is applied to the AND gate 78. As the second oscillator 79 is oscillating at a frequency six times as high as the frequency of the first oscillator 77, as shown in FIG. 8*e*, the AND gate 78 generates pulse signals at the frequency of the second oscillator 79 only during a time interval T2 which is the time interval $T_{OL}$ minus the time interval T1 as indicated in FIG. 8*f*. Thus, as is apparent from FIG. 8*g*, the OR gate 80 applies to the stepper motor drive circuit 81 the pulse signals at the frequency of the first oscillator 77 for the time interval T1, and then the pulse signals at the frequency of the second oscillator 79 for the time interval T2, whereby the stepper motor 31 which is responsive to these pulse signals, is operated at a low speed for the T1 period, and at a high speed for the T2 period.

The rotary movement of the stepper motor 31 is transmitted to the feed drive shaft 21 via the drive gear 32, fourth intermediate gear 34, driven gear 23 and through clutch connection between the sleeve portion 24 and sleeve 26, and thus the feed rollers 22 are rotated together with the feed drive shaft 21. With the above arrangement, the feed rollers 22 are rotated so that the paper P is fed initially at 0.5 inch/second, and subsequently at 3 inch/second.

As described above, the initial rotation speed of the feed rollers 22, i.e., the initial paper feeding speed is made lower so that no slip will take place between the rollers 22 and the paper P. Thus, the paper P is stably fed without a failure of its leading end in passing a lower end portion 10*a* of the main frame 10 toward the paper insertion and guide assembly A and the printing assembly R. Further, the paper feeding will not require a long time because of the acceleration of the rotation speed of the rollers 22 after the timer 73 has been timed out. During rotation of the stepper motor 31, the platen 2 is rotated in similar fashion through the second intermediate gear 41 integrally rotating with the drive gear 32, and other transmission elements. With the rotation of the platen 2 in cooperation with the guide rollers 3, 4, 5, the paper P is advanced with the leading edge passing through a printing level or line Q. The long-duration timer 70 is adapted to be timed up and stop the stepper motor 31 when the leading edge has reached the printing start position as shown in FIG. 4. At the same time, the solenoid 30 is de-energized and the end of the pivot member 28 is put in the rotational path of the operating end 27*a* of the clutch spring 27, whereby the driven gear 23 is disconnected from the sleeve 26 and the feed drive shaft 21 is made free to rotate.

After the paper P has been advanced to its printing start position, a printing operation by the printing assembly R indicated in FIG. 6 is commenced. During the printing operation, the platen 2 is rotated by the stepper motor 31 to advance the paper P for effecting the printing of a desired number of lines. The paper P is fed past the guide plate 8 and directd into the paper exit path defined by the first and second paper guides 59 and 63, and the leading edge of the paper P is guided to the first and second pairs of ejection rollers 51 and 53. The first support rod 50 and the first pair of ejection rollers 51 secured thereto are rotated by the stepper motor 31 through the driven gear 23 and the first, second and sixth intermediate gears 25, 54, 55. The second pair of ejection rollers 53 are rotated following the positively rotated ejection rollers 51. Therefore, the paper P fed along the exit path between the paper guides 59 and 63 is ejected by the ejection rollers 51 and 53 into the second stacker S2. Thus, the printing on the single sheet of paper P is completed.

It is apparent from the foregoing description that the printing operation is performed with the carriage 94 being moved relative to the paper P under control of the carriage drive unit 84 according to the left/right margin and tab setting information stored in the first memory 82 which is made effective because of the absence of a detectional signal from the limit switch 66 which is kept in its open position.

When it is desired to interrupt printing operations on the sheets of paper P and feed a sheet of paper W different in size from the sheet P to the platen 2, the sub-frame 56 is pivoted to its second, retractd position shown in FIG. 5 from its first, operative position shown in FIGS. 1A and 4. As the sub-frame 56 is pivoted, the lower end of the first paper guide 59 is moved in contact with the surface of the guide portion 60 while, at the same time, the operating piece 64 of the second paper guide 63 disengages from the protuberance 61 of the first paper guide 59 and the second paper guide 63 is pivoted clockwise as seen in FIG. 4. As a result, the lower end of the second paper guide 63 is put into abutment on the outer surface of the first paper guide 59 at its intermediate portion between the lower end and the protuberance 61, and thus the paper exit path opening is closed as shown in FIG. 5. In this condition, the sub-frame 56 is retracted in the main frame 10 and held in its second or inoperative position. The external portion of the sub-frame 56, and the first and second paper guides 59 and 63 cooperate to form a substantially flat continuous guide surface which partly define an inlet path for different size or format paper. Consequently, the sheet of paper W can then be inserted toward the platen 2 while it is guided along the guide surface and through an open space between the first paper guide 59 and the guide plate 8. Thus, the previously discussed second paper handling assembly of the paper feeding device B also includes means for defining a second paper inlet path for the sheet of paper W.

As is apparent from the foregoing description, the operating piece 64 cooperates with the first paper guide 59 to form means for actuating the second paper guide 63, which actuating means causes the second paper guide 63 to move to its second position to thereby close the exit path opening and then define the second paper inlet path when the sub-frame 56 is pivoted to its inoperative position. To this end, the first paper guide 59 need not be pivotally supported by the sub-frame 56 as in the present embodiment. The paper guide 59 may be provided in the form of a member which is supported as by the main frame 10 such that it is movable relative to the sub-frame 56 when the sub-frame is pivoted between its first and second positions.

While the second paper guide 63 is pivoted to its non-operated position, its dog piece 65 engages the actuator piece 66*a* and actuates the limit switch 66 whereby the predetermined detection signal is generated from the switch 66. In this condition, the solenoid 30 will not be energized even when the PAPER INSERT key 67*a*′ is pressed, and therefore the end of the pivot member 28 biased by the spring 29 is kept in the rotational path of the operating end 27*a* of the clutch spring 27. On the other hand, the activation of the PAPER INSERT key 67*a*′ will trigger the short-duration timer 71 because the detection signal is present. In other words, the operating time of the stepper motor 31 is changed from the time interval $T_{OL}$ to a shorter time interval $T_{OS}$ preset on the short-duration timer 71. Thus, control means are provided for changing the amount of rotation of the stepper motor 31, i.e., the amount of rotation of the platen 2 driven by the motor 31 via the drive gear 32, second intermediate gear 41, etc. Namely, control means are provided for changing the amount of insertion or initial advancement of the paper P/W with respect to the platen 2 according to the currently detected position of the sub-frame 56 or the second paper handling assembly, more specifically, the second paper guide 63. More particularly described, when the paper W is inserted the stepper motor 31 is operated for the time interval $T_{OS}$ (as shown in broken line of FIG. 8*a*) preset on the short-duration timer 71 such that the rotation during the initial time interval T1 preset on the timer 73 is carried out at a low speed and this low-speed rotation is followed by a high-speed rotation which continues for a time interval T3 which is equal to the time inteval $T_{OS}$ minus T1, as illustrated in FIG. 8*g*. Thus, the paper W is advanced up to the printing start position. In the meantime, the driven gear 23 is rotated through the fourth intermediate gear 34 and the operating end 27*a* of the clutch spring 27 remains in engagement with the end of the pivot member 28 which lies in the rotational path of the operating end 27*a* while the driven gear 23 is rotating. As a result, the driven gear 23 is disconnected from the sleeve 26 and the feed rollers 22 remain at rest whereby the sheet of paper P stored in the first stacker S1 will not be fed therefrom i.e. will be prevented from being fed by the paper feeding means. The control device 68 to which the detection signal has been applied from the limit switch 66, renders effective the second memory 83 and makes it possible to store into this memory 83 information on the settings of the left/right margin positions and tab positions of the paper W and control the carriage drive unit 84 according to the stored information.

When it is desired to restore the printing apparatus to resume the interrupted printing operation on the sheets of paper P after printing on the paper W has been completed, the sub-frame 56 is returned to its normal operated position by pivoting it frontwardly. This pivotal movement of the sub-frame 56 causes the first and second paper guides 59 and 63 to return to their normal positions shown in FIG. 4, and also causes the limit switch 66 to be turned off with a result of stopping the generation of the detection signal and re-selecting the first memory 82 as an effective memory. Thus, the carriage 94 is again movable relative to the paper P according to the information related to the left/right margin and tab positions stored in the first memory 82.

While the present invention has been described in its preferred embodiment, it is to be understood that the invention is not limited thereto but may be otherwise embodied within the scope of the following claims.

What is claimed is:

1. A paper feeding device for a printer having a printing assembly, which comprises:

a frame secured to said printer;

a first paper handling assembly supported by said frame and having a first paper stacker for storing sheets of paper of one kind and paper feeding means for feeding said sheets of paper of one kind from said first paper stacker along a first paper inlet path to said printing assembly;

a second paper handling assembly having ejection rollers and a second paper stacker for receiving said sheets of paper of one kind through said ejection rollers after said sheets of paper of one kind are printed by said printing assembly;

a sub-frame supporting said ejection rollers and retained by said frame pivotally between a first position and a second position;

at least one paper guide pivotally supported by said sub-frame;

paper guide actuating means for pivoting said at least one paper guide between a first position and a second position according to the pivotal movement of said sub-frame between said first position and said second position, said at least one paper guide defining, when placed in its first position, a paper exit path opening to guide the printed sheets of paper of said one kind from said first paper stacker toward said second paper stacker, said at least one paper guide closing said paper exit path opening when said at least one paper guide is placed in its second position; and means for defining a second paper inlet path adjacent to said second paper handling assembly and leading to said printing assembly when said sub-frame is placed in said second position thereof, whereby sheets of paper of another kind different from said one kind are loaded to said printing assembly along said second paper inlet path when said sub-frame is placed in its second position, and the printed sheets of paper of said another kind are prevented from being received in said second paper stacker.

2. A paper feeding device as recited in claim 1, wherein said at least one paper guide is provided with an outer surface acting as a guide surface defining a part of said second paper inlet path when said at least one paper guide is placed in its second position.

3. A paper feeding device as recited in claim 1, wherein said at least one paper guide comprises two paper guides defining therebetween, when placed in said first position thereof, said paper exit path opening, and forming, when placed in said second position thereof, a continuous paper guide surface defining said second paper inlet path.

4. A paper feeding device as recited in claim 1, wherein said at least one paper guide actuating means comprises an operating piece secured to said at least one paper guide and engageable with a member which is movable relative to said sub-frame when the sub-frame is pivoted from its first position to its second position.

5. A paper feeding device as recited in claim 4, wherein said member is pivotally supported by said sub-frame.

6. A paper feeding device as recited in claim 3, wherein said two paper guides comprises a first paper guide having an upper end pivotally supported by said sub-frame, and a second paper guide having an upper end pivotally supported by said sub-frame and an operating piece engaging said first paper guide when said sub-frame is placed in its first position to define said paper exit path opening between an outer surface of said first paper guide and an inner surface of said second paper guide, said operating piece disengaging from said first paper guide when said sub-frame is pivoted from its first position to its second position to permit a lower end of the second paper guide to contact with an outer surface of the first paper guide thereby allowing an outer surface of the second paper guide to cooperate with the outer surface of the first paper guide to form said continuous paper guide surface.

7. A paper feeding device as recited in claim 6, wherein said frame includes a guide portion adjacent said first paper guide, a lower end of the first paper guide being kept in abutment on said guide portion and movable in contact with the surface of said guide portion until the outer surface of the first paper guide is brought into contact with said lower end of the second paper guide when said sub-frame is pivoted from its first position to its second position.

8. A paper feeding device as recited in claim 6, wherein said first paper guide has a protuberance engageable with said operating piece of said second paper guide and further has an intermediate portion between said protuberance and a lower end thereof, said lower end of the second paper guide contacting the outer surface of said intermediate portion of the first paper guide when said sub-frame is pivoted to its second position.

9. A paper feeding device for a printer having a printing assembly, which comprises:

a frame secured to said printer;

a first paper handling assembly supported by said frame and having a first paper stacker for storing sheets of paper of one kind and paper feeding means for feeding said sheets of paper of one kind from said first paper stacker along a first paper inlet path to said printing assembly;

a second paper handling assembly having ejection rollers and a second paper stacker for receiving said sheets of paper of one kind through said ejection rollers after said sheets of paper of one kind are printed by said printing assembly;

a sub-frame pivotally retained by said frame and supporting said ejection rollers movably between a first position at which the ejection rollers are operative to eject the printed sheets of paper of said one kind toward said second paper stacker, and a second position at which the ejection rollers are inoperative and a second paper inlet path leading to said printing assembly is provided adjacent to said second paper handling assembly; and at least one paper guide supported by said sub-frame and located at an appropriate position to guide sheets of paper of another kind different from said one kind to said printing assembly along said second paper inlet path when said sub-frame is pivoted to said second position.

10. A paper feeding device as recited in claim 9, wherein said paper guide is provided with an outer surface and an inner surface, said inner surface guiding said sheets of paper of one kind to said second paper stacker when said sub-frame is placed in said first position, said outer surface guiding the sheets of paper of said another kind along said second paper inlet path when said sub-frame is placed in said second position.

11. A paper feeding device as recited in claim 9, wherein said paper guide is pivotally supported by said sub-frame, said paper guide defining a paper exit path opening through which the printed sheets of paper of said one kind is guided to said second paper stacker when said sub-frame is placed in its first position, and closing said paper exit path opening when said paper guide is pivoted to said appropriate position.

12. A paper feeding device for a printer having a printing assembly and a paper insertion and guide assembly, which comprises:

a paper handling assembly including a first paper stacker and having an operative position and an inoperative position, said paper handling assembly feeding, when placed in said operative position, individual sheets of paper of one kind from said first paper stacker to said paper insertion and guide assembly along a first paper inlet path before the sheets of paper are individually advanced to said printing assembly by said paper insertion and guide assembly;

means for defining a second paper inlet path leading to said paper insertion and guide assembly along which sheets of paper of another different from said one kind is loaded to said paper insertion and guide assembly;

detection means for detecting said operative or inoperative position of said paper handling assembly, said detection means generating an electric detection signal representing the detected position of said paper handling assembly; and control means for changing, upon detection of said inoperative position by said detection means, an amount of advancement of the paper of said paper insertion and guide assembly.

13. A paper feeding device as recited in claim 12, which further comprises:

drive means for driving said paper handling assembly and said paper insertion and guide assembly; and trigger means for starting said drive means, said control means being connected to said detection means, said drive means and said trigger means, and selecting, upon activation of said trigger means, a first time interval during which said drive means is operated when said operative position is detected by said detection means, and a second time interval during which said drive means is operated when said inoperative position is detected.

14. A paper feeding device as recited in claim 13, which further comprises transmission means for connecting said drive means to said paper handling assembly and said paper insertion and guide assembly, said transmission means including clutch means between said drive means and said paper handling assembly, said control means causing said clutch means to disconnect said paper handling assembly from said drive means when said inoperative position is detected by said detection means whereby the sheets of paper of said one kind are not fed from said first paper stacker when said paper insertion and guide assembly is driven by said drive means for said second time interval to load and advance the sheets of paper of said another kind along with second paper inlet path while said paper handling assembly is placed in its inoperative position.

15. A paper feeding device as recited in claim 12, which further comprises a paper guide supported by support means pivotally between a first position and a second position according to the movement of said paper handling assembly between said operative and inoperative positions, said paper guide defining, when placed in its first position, a paper exit path opening to guide the printed sheets of paper of said one kind toward said second paper stacker, and when placed in its second position thereof, closing said paper exit path opening to thereby define said second paper inlet path.

16. A paper feeding device as recited in claim 15, wherein said paper guide has a dog piece engageable with said detection means to detect said first and second positions of said paper guide to indirectly detect said operative and inoperative positions of said paper handling assembly.

17. A paper feeding device as recited in claim 13, which further comprises a paper guide supported by support means pivotally between a first position and a second position according to the movement of said paper handling assembly between said operative and inoperative position, said paper guide defining, when placed in its first position, a paper exit path opening to guide the printed sheets of paper of said one kind toward said second paper stacker, and when placed in its second position, closing said paper exit path opening to thereby define said second paper inlet path, said detection means detecting said first and second positions of the paper guide to indirectly detect said operative and inoperative positions of said paper handling assembly, and said control means selecting said first time interval when said first position of the paper guide is detected and said second time interval when said second position of the paper guide is detected.

18. A paper feeding device for a printer having a printing assembly and a paper insertion and guide assembly, which comprises:

a first paper handling assembly having a first paper stacker and feeding individual sheets of paper of one kind from said first paper stacker to said paper insertion and guide assembly along a first paper inlet path to said printing assembly by said paper insertion and guide assembly;

a second paper handling assembly having ejection rollers and a second paper stacker for storing the sheets of paper which are fed through said ejection rollers out of said paper insertion and guide assembly after printing is effected by said printing assembly on said sheets of paper;

support means for supporting said ejection rollers movably between a first position at which the ejection rollers are operative to eject the printed sheets of paper of said one kind toward said second paper stacker, and a second position at which the ejection rollers are inoperative and a second paper inlet path leading to said paper insertion and guide assembly is provided adjacent to said second paper handling assembly to thereby load sheets of paper of another kind different from said one kind to said paper insertion and guide assembly along said second paper inlet path; and detection means for detecting said first or second position of said ejection rollers, said detection means generating an electric detection signal representing the detected position of said ejection rollers; and control means for changing, upon detection of said second position by said detection means, an amount of advancement of the paper by said paper insertion and guide assembly.

19. A paper feeding device as recited in claim 18, which further comprises:

drive means for driving said first paper handling assembly and said paper insertion and guide assembly; and trigger means for starting said drive means, said control means being connected to said detection means, said drive means and said trigger means, and selecting, upon activation of said trigger means, a first time interval during which said drive means is operated when said operative position is detected by said detection means, and a second time interval during which said drive means is operated when said inoperative position is detected.

* * * * *